US006126317A

United States Patent [19]

Anderson et al.

[11] Patent Number: 6,126,317

[45] Date of Patent: Oct. 3, 2000

[54] CONFIGURATION RESISTING TEAR PROPAGATION IN CONTAINER SIDEWALL

[75] Inventors: Richard Floyd Anderson, Alpharetta, Ga.; Michael A. Bullock, McComb, Miss.; Mark Steele, New Prague, Minn.; Robert R. Shankle, Fayetteville, Ark.

[73] Assignee: Pac One, Inc., Dunwoody, Ga.

[21] Appl. No.: 09/372,818

[22] Filed: Aug. 11, 1999

[51] Int. Cl.[7] ..... B65D 33/00

[52] U.S. Cl. ..... 383/207; 383/66; 383/903; 229/87.05

[58] Field of Search ..... 383/66, 207, 208, 383/903; 229/87.05

[56] References Cited

U.S. PATENT DOCUMENTS

| | | | |
|---|---|---|---|
| 2,085,766 | 7/1937 | Potdevin et al. | 383/903 X |
| 2,779,144 | 1/1957 | Nail | 383/903 X |
| 3,480,198 | 11/1969 | Repko . | |
| 4,119,268 | 10/1978 | Segura | 383/903 X |
| 4,226,330 | 10/1980 | Butler . | |
| 4,292,332 | 9/1981 | McHam | 383/207 X |
| 4,460,088 | 7/1984 | Rugenstein et al. | 229/87.05 X |
| 4,557,385 | 12/1985 | Robinson . | |
| 4,919,272 | 4/1990 | Kai et al. . | |
| 5,036,978 | 8/1991 | Frank et al. . | |
| 5,038,547 | 8/1991 | Kai et al. . | |
| 5,333,735 | 8/1994 | Focke et al. | 229/87.05 X |
| 5,464,285 | 11/1995 | Anderson . | |
| 5,487,503 | 1/1996 | Sato et al. . | |
| 5,588,527 | 12/1996 | Youngs | 383/66 X |
| 5,601,368 | 2/1997 | Bodolay et al. | 383/68 X |

FOREIGN PATENT DOCUMENTS

| | | | |
|---|---|---|---|
| 507910 | 1/1955 | Italy | 229/87.05 |
| 338762 | 7/1959 | Switzerland | 229/87.05 |

*Primary Examiner*—Jes F. Pascua
*Attorney, Agent, or Firm*—Kennedy Covington Lobdell & Hickman, LLP

[57] ABSTRACT

A container in which an opening is formed by tearing includes a sidewall having a primary weakened line extending a length between opposed linear ends thereof, tearing along the primary weakened line forming an opening in the sidewall; and two secondary weakened lines formed in said sidewall, each said secondary weakened line including a portion thereof disposed in spaced, partially overlapping parallel relation to a respective said linear end of said primary weakened line, said portion of each said secondary weakened line having a length substantially less than said length between said ends of said primary weakened line. The secondary weakened lines each consist of a single elongated slit. Alternatively, the secondary weakened lines are substantially U-shaped; L-shaped; T-shaped; I-shaped; C-shape; or spirally shaped and may merge with the opposed ends of the primary weakened line. A web of material for forming bags on a form fill machine includes these primary weakened lines and secondary weakened lines.

24 Claims, 6 Drawing Sheets

CONFIGURATION RESISTING TEAR PROPAGATION IN CONTAINER SIDEWALL

FIELD OF THE PRESENT INVENTION

The present invention relates to the controlled tearing of a sidewall of a container to form an opening and, in particular, to a structure for limiting the propagation of the tear beyond its intended boundary in the sidewall during opening of the container.

BACKGROUND OF THE PRESENT INVENTION

A slit-like opening in a container is commonly formed by the tearing of a sidewall of the container with the tear propagating along a weakened line. The weakened line is formed in the sidewall during manufacture of the container. The weakened line typically comprises a line of perforations (or small cuts) in the sidewall or, alternatively, an elongated area of reduced thickness of the material forming the sidewall. The tear commonly is initiated by a pull-tab that is easily grasped with fingers and pulled to create a shear force in the sidewall of the container along the weakened line. FIGS. 1 and 2 respectively illustrate a conventional weakened line 20 that is formed in a sidewall 22 of a flexible food storage bag 24, and the resultant opening 26 formed in the bag when the sidewall is torn along the weakened line.

Containers made of plastic material, such as a plastic film food storage bag, commonly exhibit the characteristic that the plastic material is very difficult to puncture but, once a tear has been initiated in the material, the tear propagates very easily. When a tear is made to form a slit-like opening in the food storage bag, more often than not the tear propagates beyond the weakened line thereby enlarging the opening beyond its intended dimension. Consequently, the product contained in the bag can spill out during the opening of the bag depending upon the extent that the sidewall is torn beyond the weakened line defining the intended opening. Furthermore, if the opening is designed to be reclosable, the extended tearing of the sidewall usually impairs the reclosable feature of the bag.

A need therefore exists for the provision of a means for limiting the propagation of the tear from beyond the weakened line thereby insuring that the opening formed does not exceed the intended opening for which the container is specifically designed.

SUMMARY OF THE PRESENT INVENTION

Briefly, the present invention relates to containers having a sidewall which is torn to gain access to the interior of the container. In particular, the present invention relates to containers formed from a flexible film-like plastic material for food storage which includes means for forming an opening in the sidewall for gaining access to the interior of the container. The container of the present invention thus includes a sidewall having a primary weakened line extending a predetermined length between opposed linear ends thereof, tearing along the weakened line forming the opening in the container. The weakened line preferably extends transverse to opposite sides of the container with each opposed end of the weakened line being disposed in proximity to the opposite container sides. The primary weakened line preferably is formed by a plurality of perforations, but also can be equivalently formed by formation of an elongated area of reduced thickness of the sidewall of the container. The tearing along the primary weakened line preferably forms a slit-like opening in the sidewall of the container.

In accordance with the present invention, means is provided in the sidewall for limiting propagation of the tear beyond the primary weakened line during opening of the container.

In the preferred embodiments of the present invention, the container is a food storage bag. In one such preferred embodiment, two secondary weakened lines are formed in the sidewall, each secondary weakened line being disposed in spaced, partially overlapping parallel relation to a respective opposed linear end of the primary weakened line. Furthermore, each secondary weakened line has a length that is substantially less than the length between the opposed ends of the primary weakened line and, preferably, each secondary weakened line consists of a single elongate slit.

In other preferred embodiments of the present invention, the secondary weakened lines each are substantially I-shaped, U-shaped, L-shaped, T-shaped, or spirally-shaped.

In a feature of the present invention, the primary weakened line defines a pull-tab midway between the ends thereof which facilitates tearing of the sidewall.

The present invention also encompasses a web of material used in making the aforesaid bags of the present invention.

BRIEF DESCRIPTION OF THE FIGURES

Further features, embodiments, and advantages of the present invention will become apparent from the following detailed description with reference to the drawings, wherein.

DETAILED DESCRIPTION OF PREFERRED EMBODIMENTS

Figure 1:
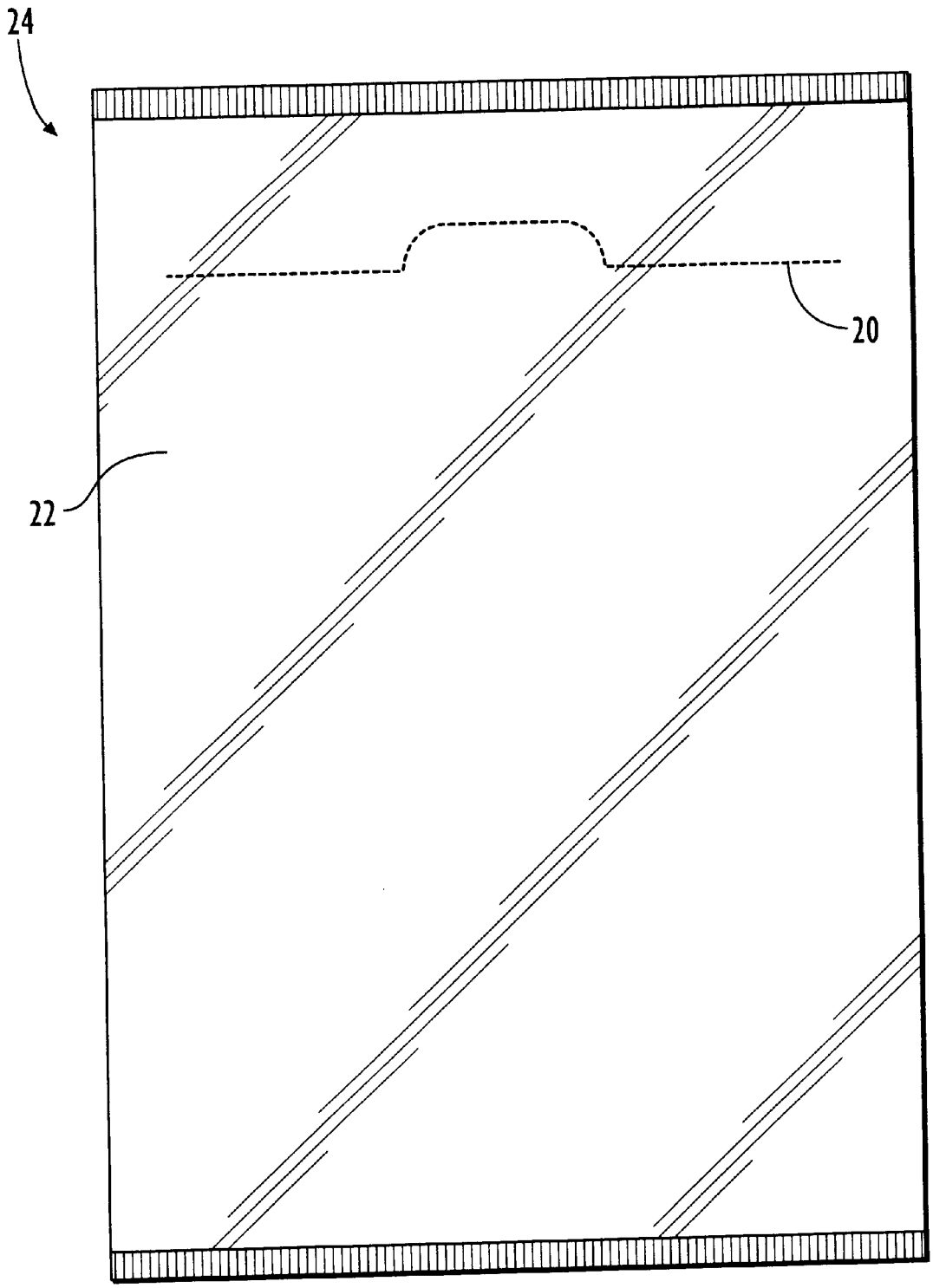
FIG. 1. (PRIOR ART)
FIG. 1 is a plan view of a conventional bag having a weakened line for forming an opening therein.
Figure 2:
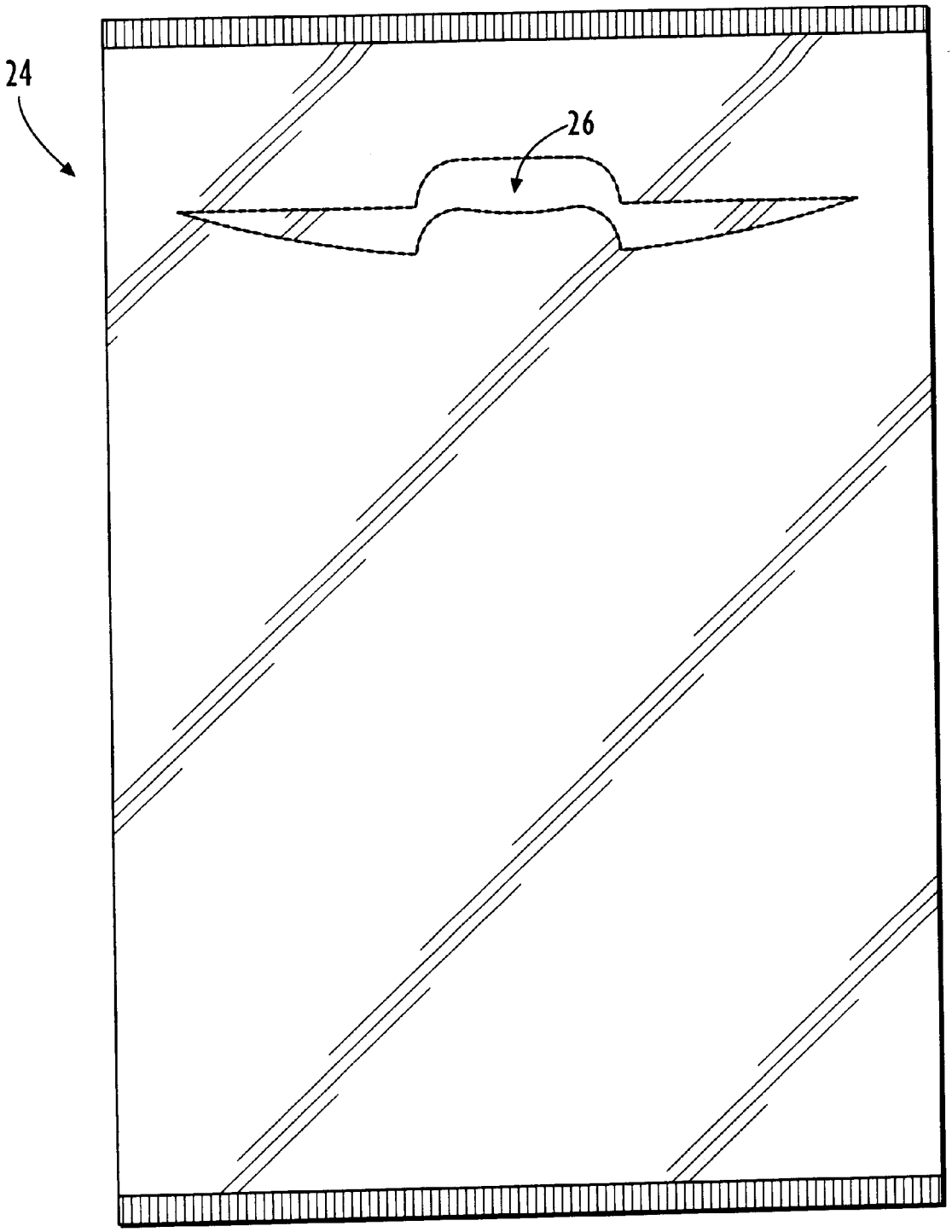
FIG. 2. (PRIOR ART)
FIG. 2 is a plan view of the bag of FIG. 1 wherein a tear has been carefully formed along the weakened line to form a slit-like opening in the bag.

Preferred embodiments of the present invention will now be described in detail with reference to FIGS. 3–12, wherein like structures are identified by like reference numerals.

Figure 3:
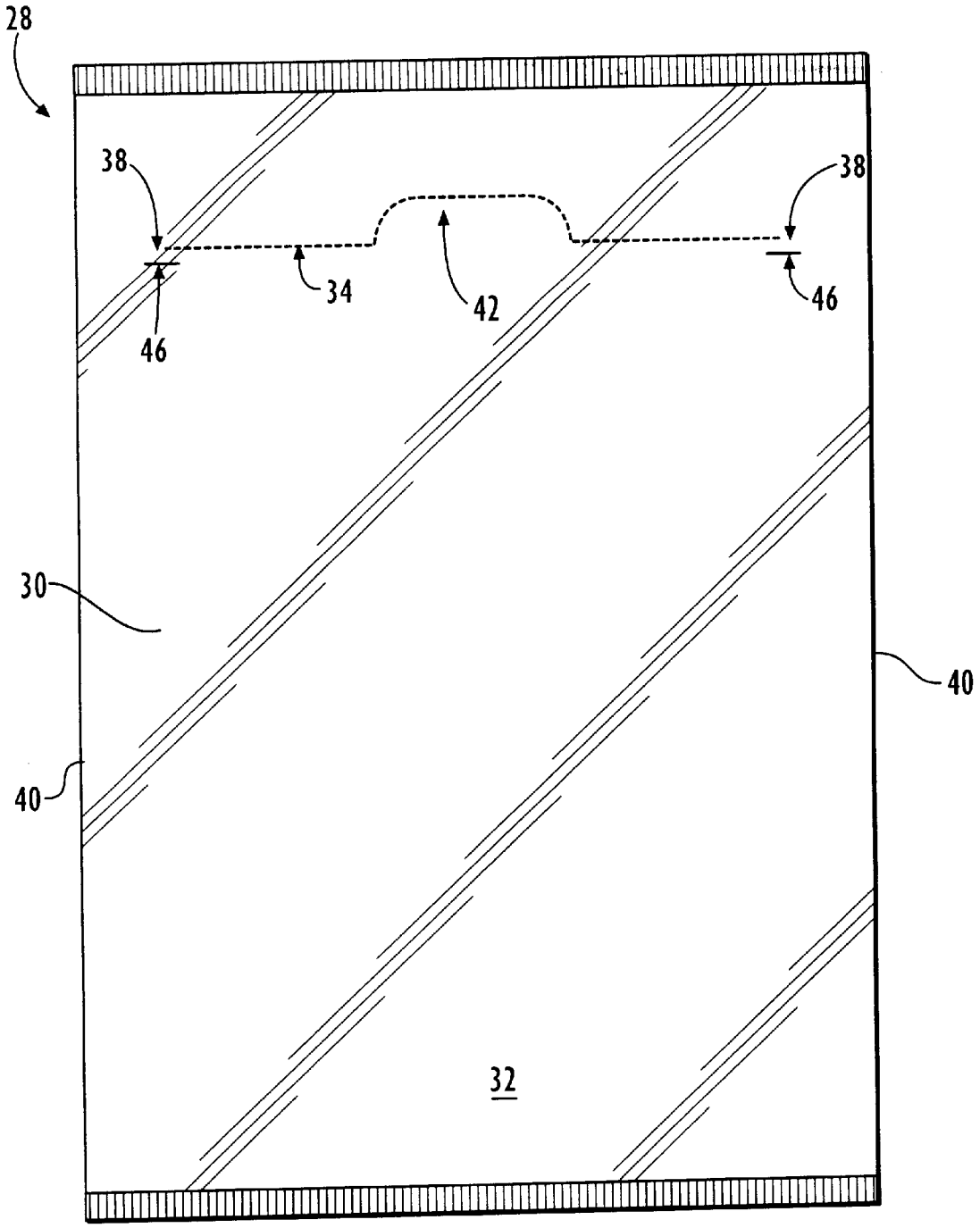
FIG. 3 a plan view of a preferred food storage bag of the present invention having a primary weakened line for forming an opening therein and having secondary weakened lines for inhibiting the propagation of unintentional tearing of the bag.

A preferred container of the present invention comprises a food storage bag 28 shown in FIG. 3. The bag 28 includes a sidewall 30 made from a conventional film-like plastic material 32 having a primary weakened line 34 extending a predetermined length between opposed linear ends 38 thereof and transverse to opposite sides 40 of the bag 28. The primary weakened line 34 further defines a pull-tab 42 disposed midway between the opposed linear ends 38 that facilitates tearing of the sidewall 30.

Preferably, the primary weakened line 34 is formed by a sequence of a plurality of adjacent perforations; however, the primary weakened line 34 equivalently may be formed by an elongated area of reduced thickness of the sidewall 30 of the bag 28 (not shown).

Figure 4:
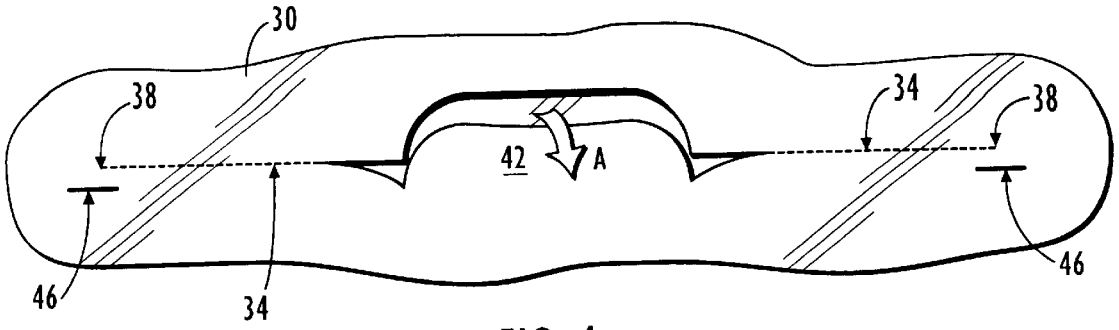
FIG. 4 is a plan view of the initiating of a tear along the primary weakened line of the bag of FIG. 3.

As is conventional, tearing along the primary weakened line 34 by pulling downward on the pull-tab 42 in the direction of arrow A in FIG. 4 forms a generally slit-like opening 44 in the sidewall 30 of the bag 28.

In accordance with the present invention, and as distinguished from conventional bags, the sidewall 30 includes two secondary weakened lines 46 disposed at the opposed linear ends 38 of the primary weakened line 24. In particular, in the preferred embodiment of FIGS. 3–6, each secondary weakened line 46 is linear and disposed in partially overlapping, parallel relation to an opposed linear end 38 of the primary weakened line 34. Furthermore, each secondary weakened line 46 has a length that is substantially less than the predetermined length between the opposed linear ends 38 of the primary weakened line 34, with each secondary weakened line 46 preferably comprising a single elongate slit. With respect to the pull-tab 42, the secondary weakened lines 46 are disposed on a side of the primary weakened line 34 opposite to that of the pull-tab 42.

Figure 5:
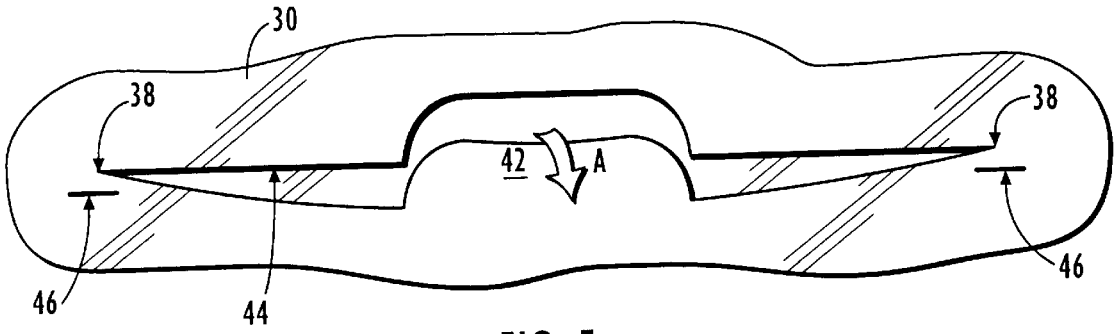
FIG. 5 is a plan view of the continuation of the tear of FIG. 4 to the opposed ends of the primary weakened line.
Figure 6:
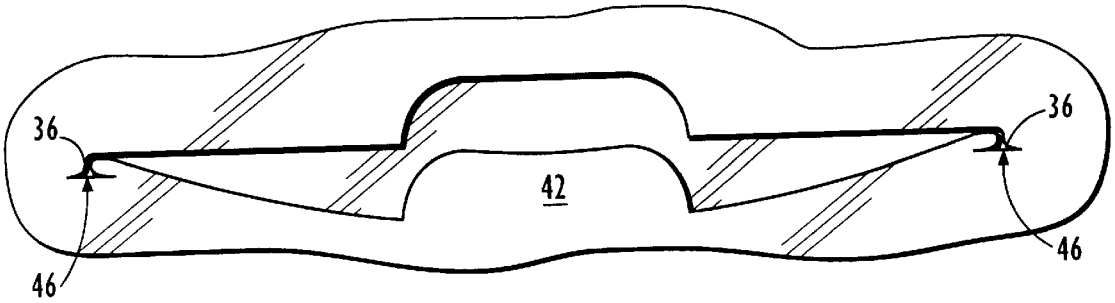
FIG. 6 is a plan view of the propagation of an unintentional tearing of the bag beyond the opposed ends of the primary weakened line in FIG. 5 to each of the secondary weakened lines.

As shown in FIG. 4, upon tearing along the primary weakened line 34 by pulling downward on the pull-tab 42 in the direction of arrow A to form the slit-like opening 44 in the bag 28, the tear is propagated from the midsection of the primary weakened line 34 at the pull-tab 42 toward the opposed linear ends 38 thereof. Once the tear has propagated to the opposed linear ends 38 of the primary weakened line 34, as shown in FIG. 5, the tear tends to continue to propagate in the direction A in which the pull-tab 42 has been pulled. Upon such further propagation 36 of the tear, the secondary weakened lines 46 are reached by the tear as shown in FIG. 6. Then, because each secondary weakened line 46 is disposed transverse to the direction A of pull of the pull-tab 42, i.e., disposed generally parallel to the opposite linear ends 38 of the primary weakened line 34, unintended further propagation of the tear orthogonal thereto is prevented.

While the disposition of the secondary weakened lines 46 in a direction transverse to the direction A tends to inhibit further propagation of the tear in the sidewall 30, it is of course recognized that sufficient force may be applied to continue propagation of the tear beyond the secondary weakened lines 46. In accordance with an objective of the present invention, however, the secondary weakened lines 46 are intended only to inhibit further propagation 36 of an unintentional tearing of the sidewall 30.

The unintentional further propagation 36 of the tear in the sidewall 30 of the bag 28 can also be accomplished by other configurations of the secondary weakened lines 46 other than a simple linear elongated slit as shown in FIGS. 3–6. In particular, the secondary weakened lines 46 may extend adjacent to the opposed linear ends 38 of the primary weakened line 34 and, moreover, may even merge with the opposed linear ends 38 of the primary weakened line 34.

Figure 7:
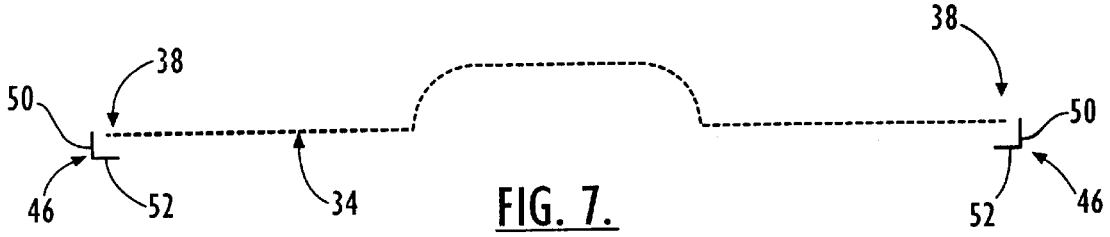
FIG. 7 is a plan view of a primary weakened line and secondary weakened lines of another preferred bag of the present invention.

In particular, each of the secondary weakened lines 46 in FIG. 7 is L-shaped and includes a first portion 50 disposed in an area immediately adjacent an opposed end 38 of the primary weakened line 34 and extending transversely to the opposed linear ends 38 of the primary weakened line 34, and a second portion 52 extending parallel to the opposed linear ends 38 of the primary weakened line 34.

Figure 8:
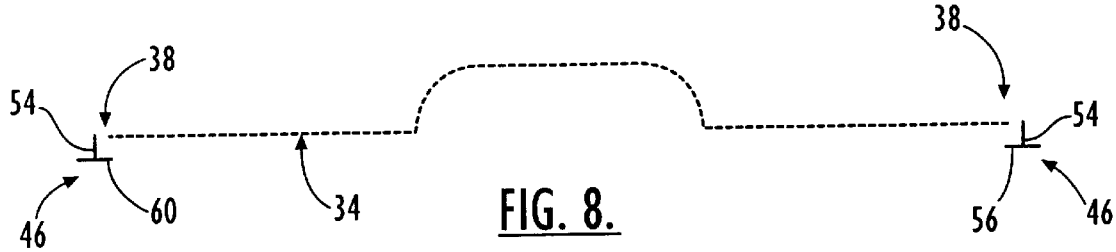
FIG. 8 is a plan view of a primary weakened line and secondary weakened lines of a third preferred bag of the present invention.

In FIG. 8 each of the secondary weakened lines 46 is T-shaped and includes a first portion 54 disposed in an area immediately adjacent an opposed end 38 of the primary weakened line 34 and extending transversely to the opposed linear ends 38 of the primary weakened line 34, and a second portion 56 extending parallel to the opposed linear ends 38 of the primary weakened line 34.

Figure 9:
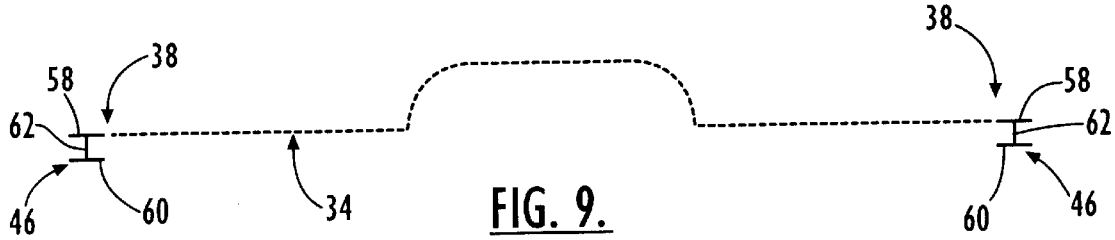
FIG. 9 is a plan view of a primary weakened line and secondary weakened lines of a fourth preferred bag of the present invention.

In FIG. 9 each of the secondary weakened lines 46 is I-shaped with a first portion 58 extending co-linear with the opposed linear ends 38 of the primary weakened line 34, a second portion 60 extending in parallel, spaced relation thereto, and a third portion 62 extending transverse thereto and perpendicularly intersecting the first and second portions 58,60.

Figure 10:
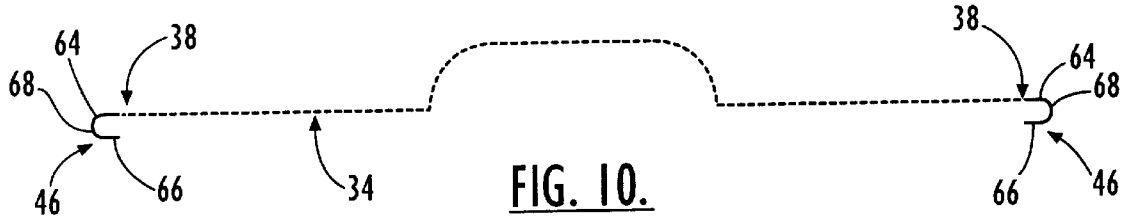
FIG. 10 is a plan view of a primary weakened line and secondary weakened lines of a fifth preferred bag of the present invention.

In FIG. 10 each of the secondary weakened lines 46 is U-shaped with a first portion 64 extending co-linear with the opposed linear ends 38 of the primary weakened line 34, a second portion 66 extending in parallel, spaced relation thereto, and a third curved portion 68 connecting the first and second portions 64,66 together in a curved arc.

Figure 11:
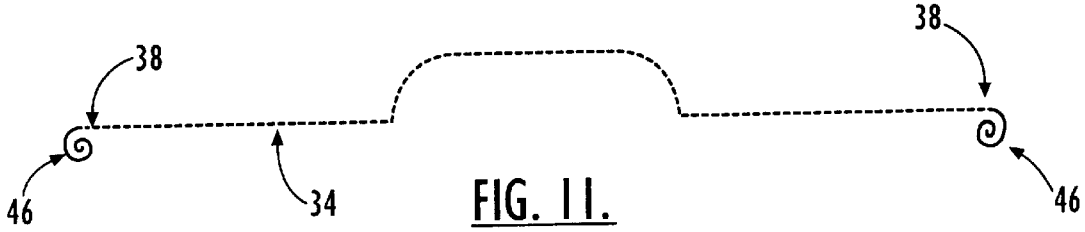
FIG. 11 is a plan view of a primary weakened line and secondary weakened lines of a sixth preferred bag of the present invention.

Finally, in FIG. 11 the secondary weakened lines 46 are spirally-shaped and merge with the opposed linear ends 38 of the primary weakened line 34, which configuration also has been found to tend to inhibit propagation of unintentional tearing in the sidewall 30.

The present invention also includes a web 70 of material 32 used to make bags 28 of the present invention. In particular, the web 70 of material 32 includes primary weakened lines 34 and secondary weakened lines 46 formed therein and is intended to be used on a vertical form fill machine. Specifically, combinations 74 of a primary weakened line 34 and two secondary weakened lines 46 are provided along a transverse length of the web 70 which will form a sidewall 30 of the bags 28 with each combination 74 being spaced approximately a bag length apart. The weakened lines 34,46 are formed by a conventional perforation-forming device 72.

It will therefore be readily understood by those persons skilled in the art that the present invention is susceptible of broad utility and application. Many embodiments and adaptations of the present invention other than those herein described, as well as many variations, modifications, and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended nor to be construed to limit the present invention or otherwise to exclude any such other embodiments, adaptations, variations, modifications and equivalent arrangements, the present invention being limited only by the claims appended hereto and the equivalents thereof.

Figure 12:
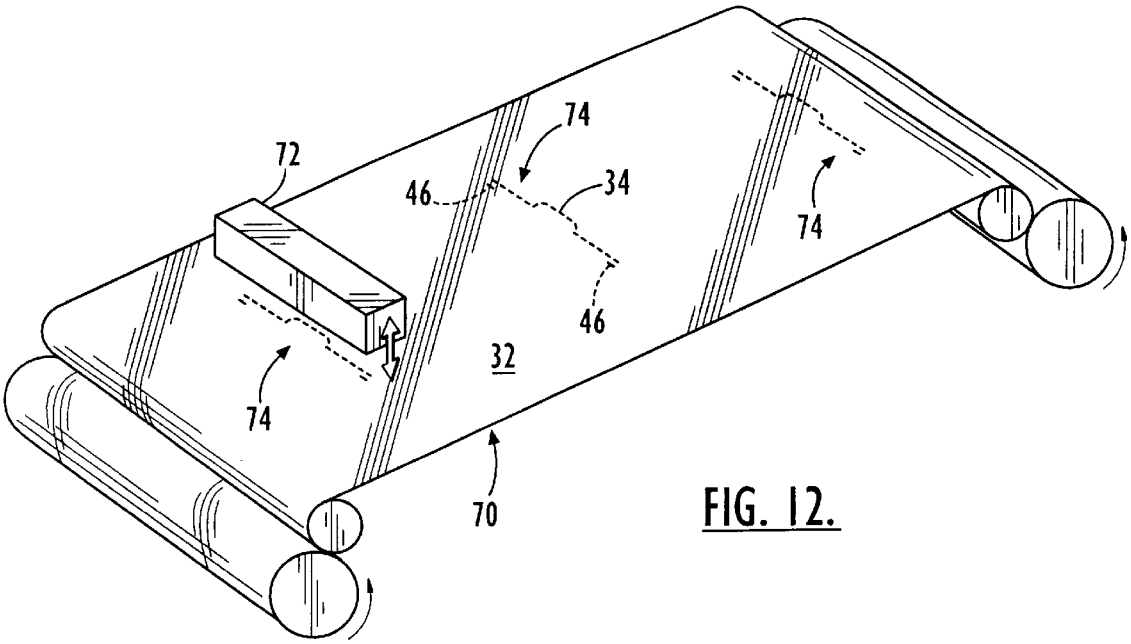
FIG. 12 is a perspective view of a method for forming a web of material used to make the bags of the present invention.

Thus, for example, it will be apparent to one having ordinary skill in the art that a similar web of material similar to that of FIG. 12 could also be made in accordance with the present invention for use on horizontal form fill machines, with the orientation of the weakened lines being reoriented to accommodate the horizontal form fill machine.

For another example, while U-shaped configuration for the secondary weakened lines has been disclosed, it will be apparent to one having ordinary skill in the art that other substantially similar shaped configurations, such as a C-shaped secondary weakened line, would also equivalently work in accordance with the present invention.

What is claimed is:

1. A container in which a slit-like opening is formed by tearing for gaining access to an interior of the container, comprising a sidewall having:

a primary weakened line extending a length between opposed linear ends thereof, tearing along the primary weakened line forming the slit-like opening in the sidewall; and two secondary weakened lines formed in said sidewall, each said secondary weakened line extending linearly in spaced, parallel relation to and in close proximity with a respective said linear end of said primary weakened line and including only a portion thereof extending in overlapping relation to said linear end of said primary weekend line, said portion of each said secondary weakened line having a length substantially less than said length between said ends of said primary weakened line, said secondary weakened lines inhibiting propagation of the tearing beyond said linear ends of said primary weakened line for maintenance of the slit-like opening.

2. A container according to claim 1, wherein said sidewall comprises a film-like material.

3. A container according to claim 1, wherein said primary weakened line defines a pull-tab midway between said ends thereof disposed on a side of said primary weakened line opposite to that of said secondary weakened lines.

4. A container according to claim 1, wherein said primary weakened line comprises an elongated area of reduced thickness of said sidewall.

5. A container according to claim 1, wherein said primary weakened line comprises a plurality of perforations.

6. A container according to claim 1, wherein said secondary weakened lines each comprise a single elongated slit.

7. A container according to claim 1, wherein said secondary weakened lines are substantially U-shaped.

8. A container according to claim 1, wherein said secondary weakened lines are substantially L-shaped.

9. A container according to claim 1, wherein said secondary weakened lines are substantially T-shaped.

10. A container according to claim 1, wherein said secondary weakened lines are substantially I-shaped.

11. A container in which a slit-like opening is formed in a sidewall by tearing for gaining access to an interior of the container, the sidewall having:

a primary weakened line extending a length between opposed ends thereof, tearing along the primary weakened line forming the slit-like opening in the sidewall; and two secondary weakened lines formed in said sidewall, each said secondary weakened line being spirally shaped and extending from said opposed ends of said primary weakened line, said secondary weakened lines inhibiting propagation of the tearing beyond said linear ends of said primary weakened line for maintenance of the slit-like opening.

12. A web of film used to make bags, said web comprising, a plurality of primary weakened lines each extending a predetermined length between opposed linear ends thereof, tearing along each said primary weakened line forming a slit-like opening in said web; and a plurality of pairs of secondary weakened lines, each said secondary weakened line of each said pair extending linearly in spaced, parallel relation to and in close proximity with a respective said linear end of a said primary weakened line and including only a portion thereof extending in overlapping relation to said linear end of said primary weekend line, said portion of each said secondary weakened line of said pair having a length substantially less than said predetermined length between said opposed ends thereof, each respective said pair secondary weakened lines inhibiting propagation of the tearing beyond said linear ends of a respective said primary weakened line for maintenance of the slit-like opening.

13. A web according to claim 12, wherein each said secondary weakened lines comprises a single elongated slit.

14. A web according to claim 12, wherein said secondary weakened lines are substantially U-shaped.

15. A web according to claim 12, wherein said secondary weakened lines are substantially L-shaped.

16. A web according to claim 12, wherein said secondary weakened lines are substantially T-shaped.

17. A web according to claim 12, wherein said secondary weakened lines are substantially I-shaped.

18. A web of film used to make bags, said web comprising, a plurality of primary weakened lines each extending a predetermined length between opposed ends thereof, tearing along each said primary weakened line forming a slit-like opening in said web; and a plurality of pairs of secondary weakened lines, each said secondary weakened line of each said pair being spirally shaped and extending from said opposed ends of said primary weakened line, said secondary weakened lines of each said pair inhibiting propagation of the tearing beyond said linear ends of said primary weakened line for maintenance of the slit-like opening.

19. A container in which a slit-like opening is formed in a sidewall thereof by tearing, the sidewall including:

(a) a sidewall surface bounded by top, bottom and side edges;

(b) a primary weakened line formed in said surface between and at spacings to said top, bottom and side edges, said primary weakened line extending in said surface a length between opposed linear ends thereof, tearing along the primary weakened line forming the slit-like opening in the sidewall; and (c) two secondary weakened lines formed in said surface between and at spacings to said top, bottom and side edges, each said secondary weakened line including a portion thereof extending linearly in spaced, parallel relation to and in close proximity with a respective said linear end of said primary weakened line, said portion of each said secondary weakened line having a length substantially less than said length between said ends of said primary weakened line, said secondary weakened lines inhibiting propagation of the tearing beyond said linear ends of said primary weakened line for maintenance of the slit-like opening.

20. The container of claim 19, wherein said secondary weakened lines are substantially U-shaped.

21. The container of claim 19, wherein said secondary weakened lines are substantially L-shaped.

22. The container of claim 19, wherein said secondary weakened lines are substantially T-shaped.

23. The container of claim 19, wherein said secondary weakened lines are substantially I-shaped.

24. The container of claim 19, wherein said secondary weakened lines each comprise a single elongated slit.

* * * * *